US005345369A

United States Patent [19]

Ruud et al.

[11] Patent Number: 5,345,369

[45] Date of Patent: Sep. 6, 1994

[54] OPTICAL SYSTEM FOR LAMP-MOUNTING ELONGATE ROOF FIXTURE

[75] Inventors: Alan Ruud, Racine; Eric Haugaard, Kenosha, both of Wis.

[73] Assignee: Ruud Lighting, Inc., Racine, Wis.

[21] Appl. No.: 981,605

[22] Filed: Nov. 25, 1992

[51] Int. Cl.[5] ..... F21S 1/02

[52] U.S. Cl. ..... 362/145; 362/221; 362/351; 362/427; 362/362

[58] Field of Search ..... 362/145, 221, 217, 351, 362/427, 362, 147, 151, 154

[56] References Cited

U.S. PATENT DOCUMENTS 3,293,426 12/1966 Zeitz et al. ..... 362/221

5,081,567 1/1992 Weiss ..... 362/147

*Primary Examiner*—Ira S. Lazarus

*Assistant Examiner*—L. Heyman

*Attorney, Agent, or Firm*—Jansson & Shupe, Ltd.

[57] ABSTRACT

An improved lamp-mounting elongate roof fixture having a support, a beam over the support and suspended above the roof, and a light source under the beam, and characterized by a mounting plate extending along the support and movably, preferably pivotably, attached to it in a manner facilitating relamping, a lamp socket mounted to the bottom of the mounting plate to support a lamp along an axis perpendicular to the plate, and a reflector and preferably a light-transmissive protective jar, in fixed position on the support. The lamp and reflector are positioned to cast direct and reflected light below the beam and across the roof to illuminate the roof brightly with improved evenness and reduced glare. The mounting plate pivots to move the lamp from its use position in the jar and adjacent to the reflector to a raised position for relamping.

19 Claims, 6 Drawing Sheets

OPTICAL SYSTEM FOR LAMP-MOUNTING ELONGATE ROOF FIXTURE

FIELD OF THE INVENTION

This invention relates generally to lamp mounting and, more specifically, to lamp-mounting elongate roof fixtures.

BACKGROUND OF THE INVENTION

For over twenty years, McDonald's Corporation, which has well-known restaurants, has used lamp-mounting elongate roof fixtures on the roofs its restaurants as a part of its "signage." Each such roof fixture, at least in the most common form, includes a support having a roof-contact portion and an upper portion which is parallel to and spaced from the roof, a beam over and along the support in position suspended above the roof, and a light source shrouded under the beam.

One version of such roof fixtures, still in wide use, has as its light source either one centered fluorescent tube or a pair of parallel tubes, such tubes being mounted in spaces provided along the support underneath the beam. Light from these tubes is emitted below the lower edge of the beam and onto the roof portions between adjacent to the fixtures. Still another version of such roof fixtures uses what is known as "Light-Pipe" optical system to achieve the same result.

Another McDonald's roof fixture, which is the subject of U.S. Pat. No. 5,081,567 (Weiss), places a lamp inside the roof beam itself adjacent to windows formed on either side of the beam itself. A lamp, which is attached to an end closure plate, is oriented along the beam adjacent to the windows in the beam and projects light through the windows onto the roof, causing strong glare to persons around a building which has such fixtures on the roof.

All of such prior art has significant problems and disadvantages. The purpose of this invention is to overcome such problems and disadvantages.

In addition to the problem of glare, the roof fixture of the Weiss patent has its ballast located at a position remote from the lamp. Such position of the ballast can tend to complicate service in that a serviceperson must be on the roof to deal with the ballast. Furthermore, the orientation of the lamp, in a direction along the beam, is quite inefficient if the purpose is to illuminate the roof surface, inasmuch as the primary directions for light discharge from the lamp are not fully oriented toward the area intended to be lit. And, if the lamp is of the high intensity discharge (HID) type having an arc stream, the generally horizontal orientation of the lamp causes the arc-stream of the lamp to droop toward that part of the lamp which is under the arc stream, which can result in a hot spot significantly shortening lamp life.

While the nature of the lamp used in the Weiss patent causes a higher level of roof illumination than fluorescent lamps provided, or were intended to provide, illumination of the roof surface by the Weiss fixture, with its above-the-beam support and light projecting out windows formed in the sides of the beams, has been observed to be very uneven. And, as already noted, the side glare caused by such windowed configuration is understood to be a problem.

A lamp-mounting elongate roof fixture, with an optical system which provides better intensity and evenness of light on the roof, uses light and energy more efficiently, eliminates glare, and is easier to maintain, would be an important advance.

OBJECTS OF THE INVENTION

It is an object of the invention to provide an improved lamp-mounting elongate roof fixture overcoming some of the problems and shortcomings of the prior art.

Another object of the invention is to provide an improved roof-fixture optical system which directs.

Still another object of the invention is to provide an improved lamp-mounting elongate roof fixture which improves the intensity of laterally-directed light.

Another object of the invention is to provide an improved lamp-mounting roof fixture which illuminates the roof brightly and avoids lamp hot spots to prolong lamp life.

Yet another object of the invention is to provide a lamp-mounting elongate roof fixture which reduces or eliminates glare.

Another object of the invention is to provide an improved optical system which, when integrated with a roof beam, provides better intensity and evenness of light on the roof.

Another object of the invention is to provide a lamp-mounting elongate roof fixture which is easy to maintain.

How these and other objects are accomplished will become apparent from the following descriptions and from the drawing.

SUMMARY OF THE INVENTION

The improvement of this invention is a lamp-mounting elongate roof fixture overcoming problems of prior art devices of this sort, including those problems mentioned above. More specifically, this invention provides an optical system which substantially improves the intensity and evenness of lighting, drastically reduces or eliminates glare problems of prior devices, avoids lamp hot spots and thus prolongs lamp life, is easy to maintain and relatively inexpensive to operate.

The lamp-mounting elongate roof fixture of this invention is an improvement in fixtures of the type having a support with a roof-contact portion and an upper portion parallel to and spaced from the roof, a beam over and along the support in position suspended above the roof, and a light source under the beam.

The device includes a mounting plate having a top and bottom, extending along the support parallel to the upper portion thereof, and movably attached to the support to facilitate relamping, which is easy when the mounting plate is moved to a relamping orientation. A lamp socket is mounted to the bottom of the mounting plate and supports a lamp below the mounting plate and oriented along an axis which is substantially perpendicular to the mounting plate. A reflector is in a lamp-adjacent position below the upper portion of the support, and the lamp and reflector are positioned to cast direct and reflected light below the beam and across the roof.

In highly preferred embodiments, the mounting plate has proximal and distal ends and is pivotably attached at its proximal end to the support, and the lamp socket is mounted adjacent to the distal end. The elongate roof fixture has a lower end, which is along the edge of the roof, and the proximal end of the mounting plate is preferably spaced from such lower end by a distance about equal to the distance from the proximal end to the distal end. Thus, the distal end of the mounting plate can be lifted to pivot the mounting plate about its pivotable attachment, thus facilitating relamping.

It is highly preferred that the lamp ballast which forms a part of the lighting apparatus be attached to the mounting plate, and most preferably such ballast is on top of the mounting plate. This serves to facilitate ballast replacement or other service on the ballast.

The reflector preferably extends around the lamp along an arc of no more than about 180° about the lamp. The reflector is substantially symmetrical about the vertical plane which includes the axis and extends parallel to the length of the support. In highly preferred embodiments, the reflector has terminal edges on opposite sides of such plane, such edges being positioned to block most or all of the direct light from the lamp to lateral positions beyond the lower end of the roof fixture.

The reflector is preferably attached to the support and in a fixed position below the upper portion of the support such that pivoting of the mounting plate moves the lamp to and from positions adjacent to the reflector. The devices preferably includes a light-transmissive protective jar which is around the lamp in the lamp is in its use position.

In preferred embodiments, the jar is below the upper portion of the support and attached to such upper portion, and has an opening which is positioned in the entire structure such that pivoting of the mounting plate moves the lamp into and out of the jar from above. The opening in the jar is defined by a lip which protrudes upwardly through a preferably round hole formed in the upper portion of the support, such lip terminating in a rim. The bottom of the mounting plate has a gasket on it positioned to engage and seal against the rim when the mounting plate is in its use position. Such sealing engagement keeps the lamp and the inside of the jar substantially free of foreign matter.

The device preferably includes a latching means which secures the mounting plate to the support to hold the mounting plate in its use position. This serves to maintain the sealing engagement of the rim and gasket. The lamp, the jar, the opening, and the reflector itself are substantially concentric with one another.

DETAILED DESCRIPTION OF PREFERRED EMBODIMENTS

Figure 1:
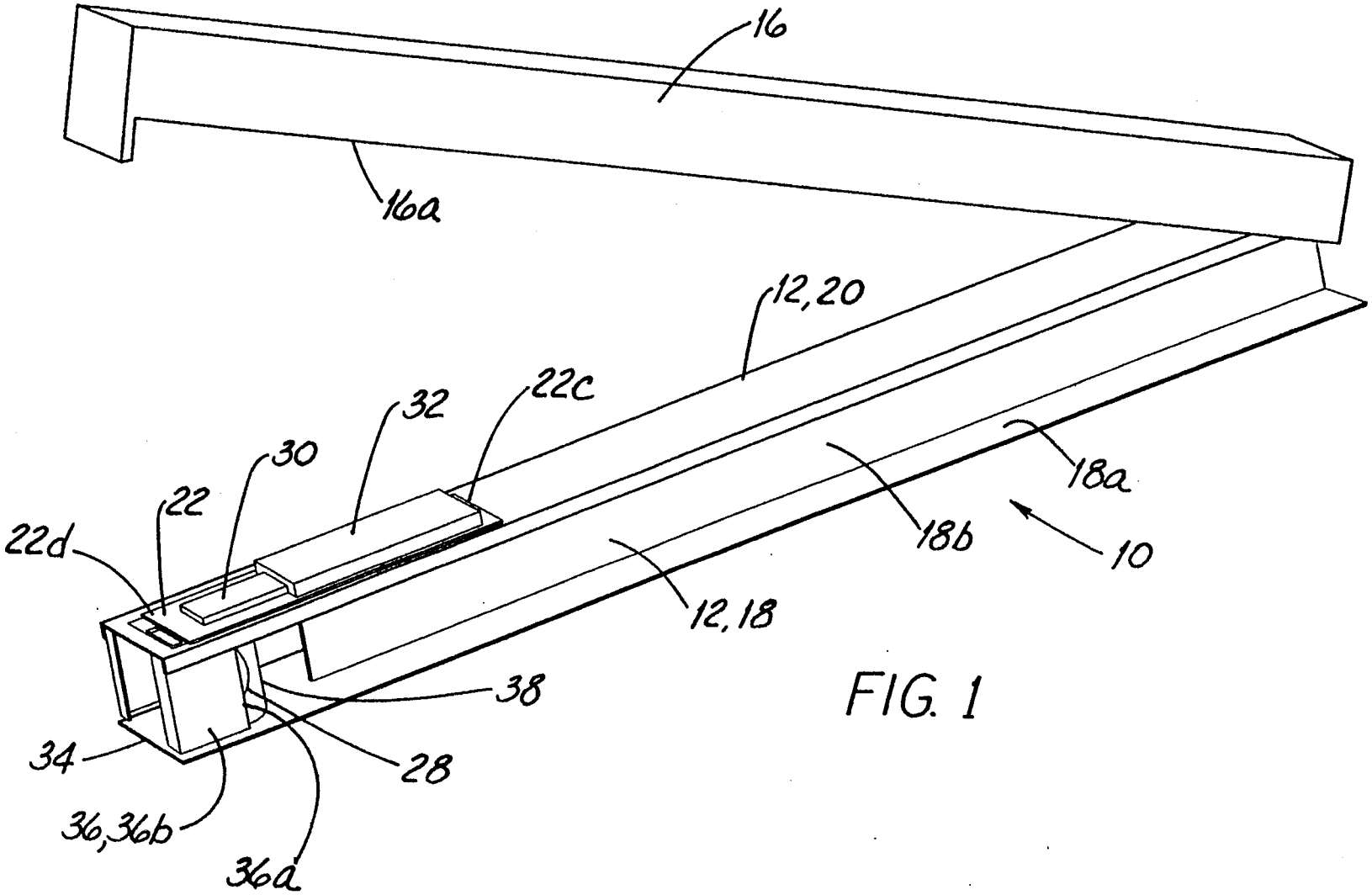
FIG. 1 is a perspective view of a lamp-mounting elongate roof fixture in accordance with this invention, with certain portions removed for clarity, such view being schematic to the extent that certain parts are shown in relative shapes and sizes unlike the shapes and sizes of such parts as shown in other views.

The figures illustrate an improved lamp-mounting elongate roof fixture 10 of the type having a support 12 on roof 14 and a beam 16 suspended by support 12 in position over roof 14. Support 12 has a roof-contact portion 18, which is in the form of an inverted T, and an upper portion 20 is parallel to and spaced from roof 14, and generally in the form of a shallow inverted U. Roof-contact portion 18 includes a base portion **18*a* and an upright portion 18*b*, the latter portion serving to rigidly attach portions 18 and 20 of support 12 to each other. As in the case of devices of the prior art, fixture 10 also includes a light source supported under beam 16**.

Beam 16 is shroud-like and has a generally planar top panel and downward extending side panels terminating in lower edges **16*a* spaced above roof 14. Beam 16 includes internal stop members 16*b* which engage upper portion 20 of support 12, such that support 12 supports beam 16 above roof 14, allowing light, as with prior roof beams, to project below and past lower edges 16*a* onto roof 14**.

All of the elements described above are a part of the prior art lamp-mounting elongate roof fixtures long used on the roofs of McDonald's Corporation restaurant roofs.

Figure 3:
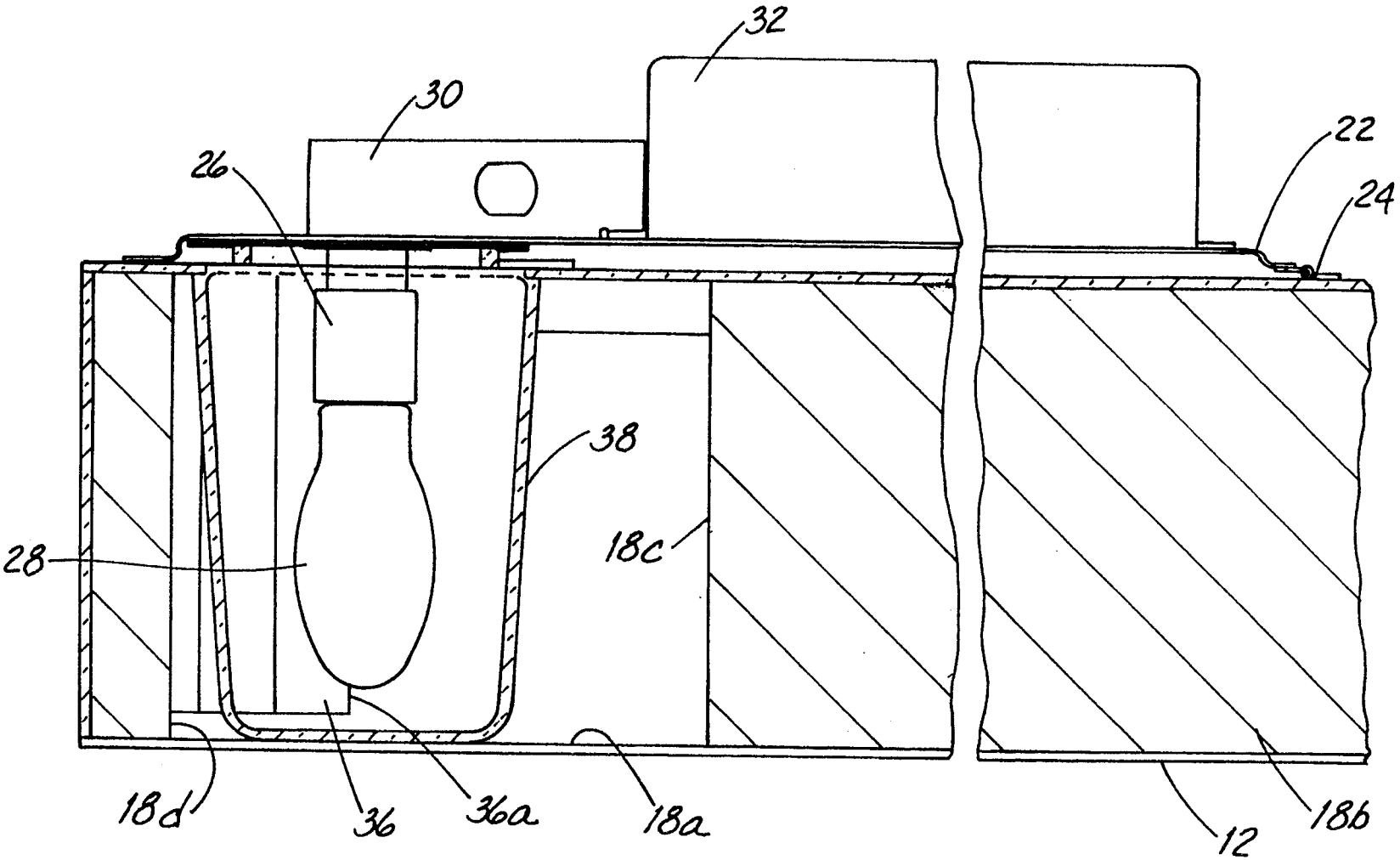
FIG. 3 is a further enlarged sectional view taken along section 3—3 as indicated in FIG. 2, with portions of background omitted for purposes of clarity.
Figure 4:
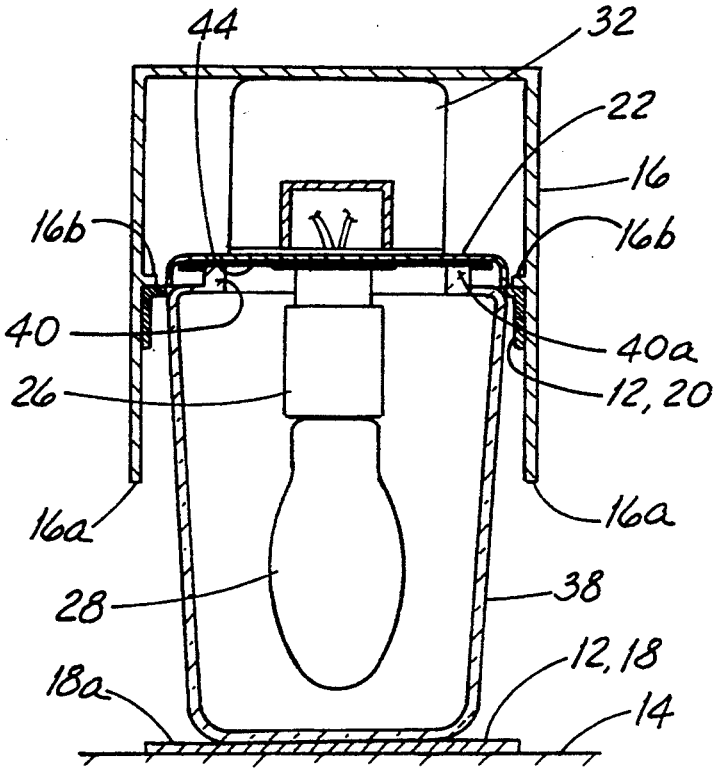
FIG. 4 is a similarly-enlarged sectional view taken along section 4—4 as indicated in FIG. 2, with portions of background omitted for purposes of clarity.

The improvement of this invention includes a mounting plate 22 having a top **22*a*, a bottom 22*b*, and proximal and distal ends 22*c* and 22*d*, respectively. Mounting plate 22 is pivotably attached at proximal end 22*c* to support upper portion 20 and, in the normal use position (as shown best in FIG. 3 and in full lines in FIG. 7), extends along the top of support upper portion 20. Such pivotable attachment is by means of hinge 24. Such attachment allows mounting plate 22** to be quickly and easily tipped upwardly for easy relamping.

A lamp socket 26 is mounted to bottom **22*b* of mounting plate 22 near distal end 22*d*. Socket 26 supports a lamp 28 below mounting plate 22, socket 26 and lamp 28 being oriented along an axis which is perpendicular to mounting plate 22. Lamp 28** is of the high-intensity discharge (HID) type having a relatively short arc stream, aligned along the aforementioned axis. Most preferably, the lamp is a 175-watt multi-vapor metal halide lamp; it has been determined that, using this invention, such light source provides roof illumination substantially in excess of the roof illumination available from certain prior devices, including certain prior devices using light sources of considerably greater power (e.g., 250 watts).

Wires (not shown) from socket 26 extend through a wire containment member 30 secured on top **22*a* of mounting plate 22 and to a lamp ballast 32** also secured at such location.

Lamp-mounting roof fixture 10 has a lower end 34 which is preferably aligned along the edge of roof 14 and mounting plate 22 is positioned relative to lower end 34 such that its proximal end **22*c* is spaced from lower end 34 by a distance approximating the distance between proximal and distal ends 22*c* and 22*d*. In other words, proximal end 22*c* is spaced from lower end 34 by a distance about equal to the length of mounting plate 22, such that distal end 22*d* thereof is within easy reach along the edge of roof 14**. This facilitates relamping and ballast service/replacement.

A reflector 36 is in a lamp-adjacent position below upper portion 20 of support 12 and lamp 28 and reflector 36 are positioned to cast direct and reflected light below beam 16 and across roof 14. Reflector 36 will be described in greater detail after other elements and structure is described.

Figure 2:
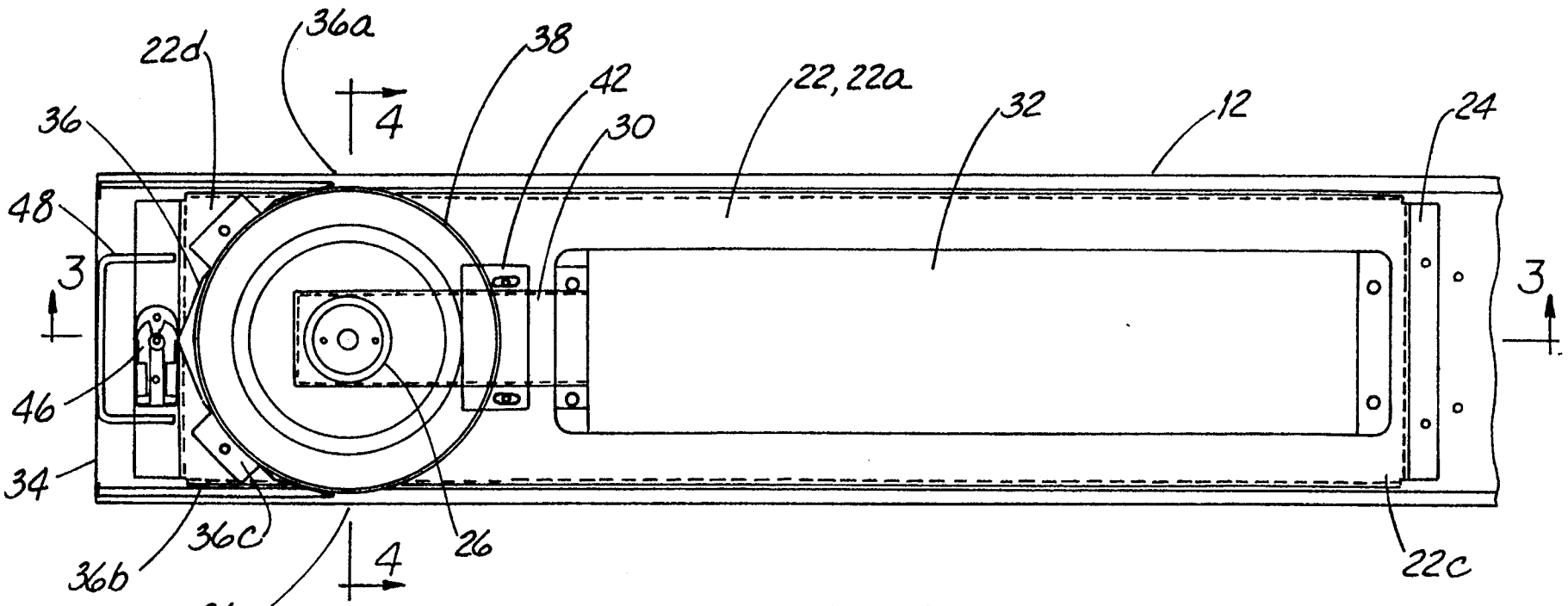
FIG. 2 is an enlarged, partially-transparent, fragmentary plan view of the lamp-mounting elongate roof fixture, excluding the beam which extends thereover in normal use position and excluding other parts for clarity.

A light-transmissive protective jar 38 is below and attached to upper portion 20 of support 12 and includes a lip which protrudes upwardly through support upper portion 20 to terminate in a rim 40. Jar 38 and reflector 36 are located between edges 18*c* and 18*d* of roof-contact portion 18 of support 12. Lip 40 and its rim 40*a* define an opening which is positioned such that pivoting of mounting plate 22 moves lamp 28 into and out of jar 38 from above. Jar 38 is mounted to support upper portion 20 by passing jar 38 from above through a large hole 20*a* in upper portion 20 until its lower end rests on base 18*a* of roof-contact portion 18. Lip 40 of jar 38 is then engaged by a locator member 42 (see FIG. 2), which holds jar 40 in position against reflector 36. The position of jar 38 is thus established to assure that the jar opening is in alignment with lamp 28.

Bottom 22*b* of mounting plate 22 has a gasket 44 affixed thereon in position to seal against rim 40*a* when mounting plate 20 and lamp 28 are in the use position. This sealing of jar 38 with lamp 28 therein prevents foreign matter, such as insects attracted by light, from entering the jar. A latch 46 (see FIG. 2) has elements on mounting plate 22 and support upper portion 20 to hold mounting plate 22 in its use position. This serves to maintain the sealing engagement of rim 40*a* with gasket 44.

Lamp 28, jar 38, the jar opening, and reflector 36 are substantially concentric with one another. Reflector 36 and jar 38 are in fixed positions in support 12, while lamp 28 is free to move into and out of jar 36 upon pivoting motion of mounting plate 22.

Figure 6:
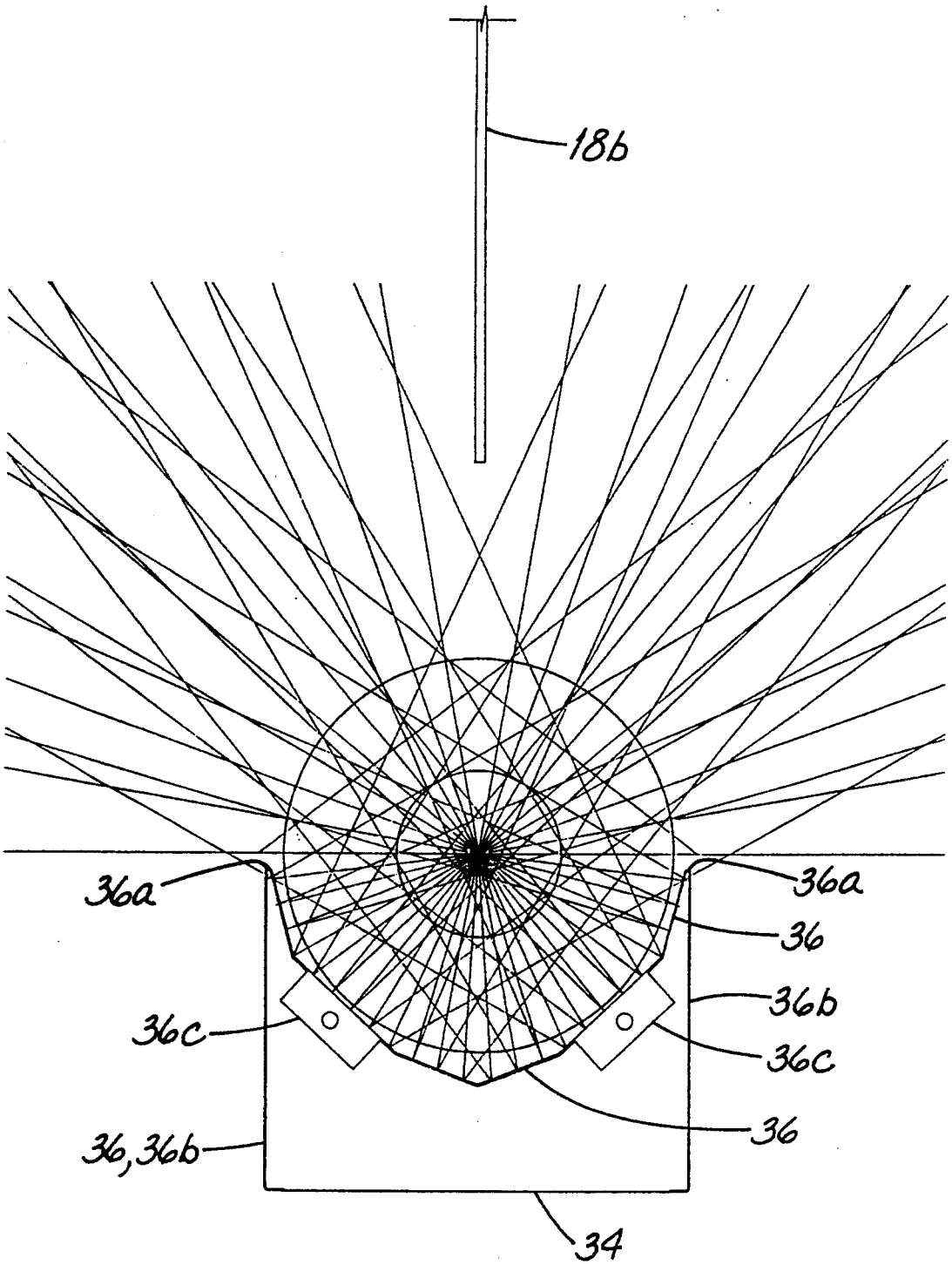
FIG. 6 is a schematic fragmentary plan view including a ray trace.

Reflector 36, which is shown best in FIGS. 2, 3, 6 and 7, particularly FIG. 6, is preferably a polished, etched and anodized aluminum element which is formed to have a number of facets surrounding lamp 28. Reflector 36 is symmetrical about the plane which contains the aforementioned lamp axis and is parallel to the length of support 12. Reflector 36 extends around lamp 28 along an arc of no more than about 180°, and has a pair of terminal edges 36*a* which are positioned to substantially block direct light from the lamp to lateral positions beyond the lower end. This blocks light in areas below the roof which are not intended to be lit.

Figure 5:
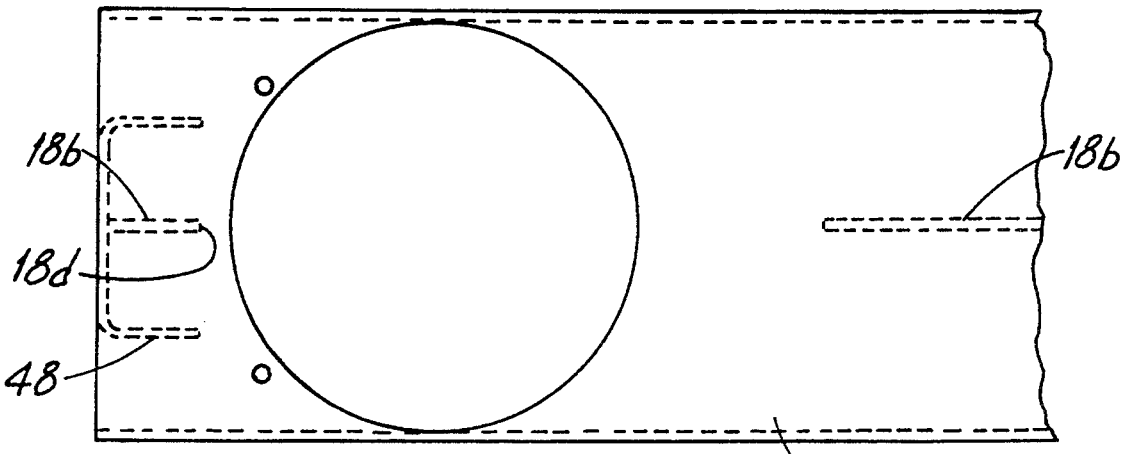
FIG. 5 is a fragmentary plan view illustrating the top surface of the support, without background.

Reflector 36 has side portions 36*b* which extend beyond and back from terminal edges 36*a* to facilitate mounting. Reflector 36 also has tabs 36*c* along its upper edge to facilitate attachment to the underside of support upper portion 20. Reflector 36 is in position such that its center facet-dividing fold line is in engagement with edge 18*d* of roof-contact portion 18, which, along with a brace member 48 (see FIGS. 2 and 5), rigidly spans between base 18*a* and support upper portion 20.

(Brace member 48 and the portion of roof-contact portion 18 which is adjacent to edge 18*d* are omitted from FIG. 1. Reflector 36 is omitted from FIG. 5, which does show roof-contact portion 18 and brace member 48.)

The ray trace of FIG. 6 illustrates the operation of the optical system of this invention. Light from lamp 28 is used with great efficiency to provide an excellent level of illumination on the roof with a high degree of evenness of illumination. As already noted, light projects under beam lower edges 16*a* onto the roof.

The ray trace of FIG. 6 is a rendering based on an assumed perfect point source (line) and assumed perfectly-specular reflector facets. In fact, a considerable amount of light is cast onto the vertical surfaces of upright portion 18*b* of support 12, and this serves to highlight the appearance of such surface. This occurs because the light source, in fact, is never a perfect light source, nor are the reflector facets perfectly specular, as already indicated by the above description of the aluminum reflector member used. Furthermore, the jar itself causes a slight degree of light scattering.

Figure 7:
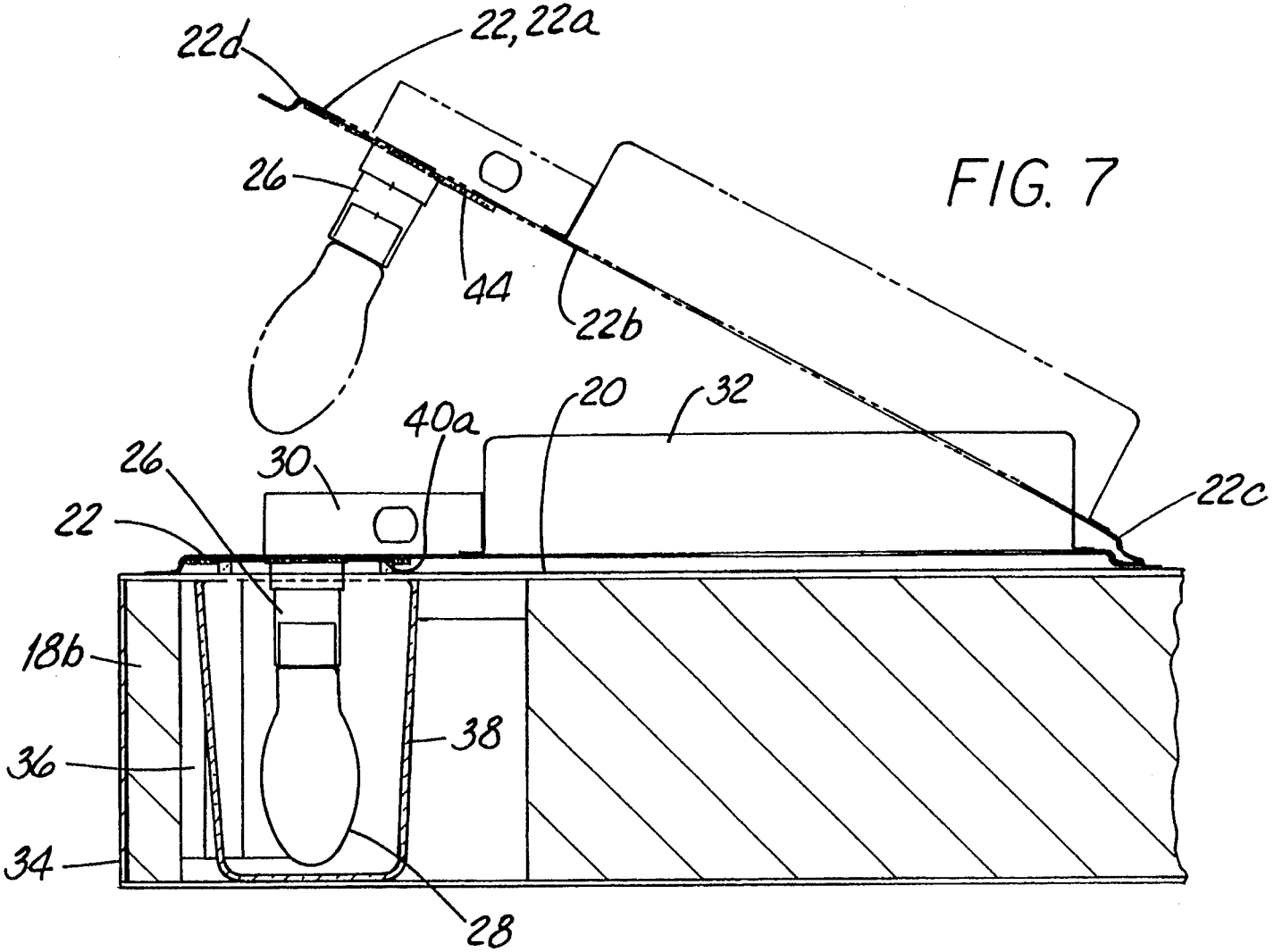
FIG. 7 is a reduced sectional view as in FIG. 3, but illustrating two different positions of the mounting plate, including a position for use and a position for relamping or other maintenance.

FIG. 7 illustrates the easy maintenance of the device of this invention. Relamping is carried out easily with mounting plate 22 and its attached apparatus in the position illustrated by phantom lines.

While the principles of this invention have been described in connection with specific embodiments, it should be understood clearly that these descriptions are made only by way of example and are not intended to limit the scope of the invention.

We claim:

1. In a lamp-mounting elongate roof fixture of the type including an elongate support having a roof-contact portion and an upper portion parallel to and spaced from the roof, a beam over and along the support in position suspended above the roof, and a light source under the beam, said roof having a lower edge, the improvement comprising:

an elongate mounting plate having a top and bottom, the mounting plate extending along the support parallel to the upper portion thereof and movably attached to the support thereby to facilitate relamping;

a lamp socket mounted to the bottom of the mounting plate and supporting a lamp therebelow oriented along an axis substantially perpendicular to the mounting plate; and a reflector in a lamp-adjacent position below the upper portion of the support, the lamp and reflector positioned to cast direct and reflected light below the beam and across the roof.

2. The lamp-mounting roof fixture of claim 1 wherein:

the mounting plate has proximal and distal ends;

the mounting plate is pivotably attached at its proximal end to the support; and the lamp socket is mounted adjacent to the distal end.

3. The lamp-mounting roof fixture of claim 2 having a lower end adjacent the lower edge of the roof and wherein the proximal end of the mounting plate is spaced from the lower end by a distance approximating the distance from the proximal end to the distal end, thereby to facilitate relamping.

4. The lamp-mounting roof fixture of claim 2 further including a lamp ballast attached to the mounting plate.

5. The lamp-mounting roof fixture of claim 4 wherein the lamp ballast is on the top of the mounting plate.

6. The lamp-mounting roof fixture of claim 5 having a lower end adjacent the lower edge of the roof and wherein the proximal end of the mounting plate is spaced from the lower end by a distance approximating the distance from the proximal end to the distal end, thereby to facilitate relamping and ballast service/replacement.

7. The lamp-mounting roof fixture of claim 1 wherein the reflector extends around the lamp along an arc of no more than about 180° thereabout and is substantially symmetrical about the plane which includes the axis and extends parallel to the length of the support.

8. The lamp-mounting roof fixture of claim 7 having a lower end and wherein the reflector has terminal edges on opposite sides of the plane, the edges being positioned to substantially block direct light from the lamp to lateral positions beyond the lower end.

9. The lamp-mounting roof fixture of claim 7 wherein:

the mounting plate has proximal and distal ends;

the mounting plate is pivotably attached at its proximal end to the support; and the lamp socket is mounted adjacent to the distal end.

10. The lamp-mounting roof fixture of claim 9 wherein the reflector is attached to the support and in fixed position below the upper portion thereof such that pivoting of the mounting plate moves the lamp to and from positions adjacent to the reflector.

11. The lamp-mounting roof fixture of claim 10 further including a light-transmissive protective jar around the lamp when the fixture is in use.

12. The lamp-mounting roof fixture of claim 11 wherein the jar is below and attached to the upper portion of the support and has an opening positioned such that pivoting of the mounting plate moves the lamp into and out of the jar from above.

13. The lamp-mounting roof fixture of claim 12 wherein:

the opening in the jar is defined by a lip which protrudes upwardly through the upper portion of the support to terminate in a rim; and the bottom of the mounting plate has a gasket thereon positioned to seal against the rim when the mounting plate is in use position such that the lamp is within the jar;

thereby preventing foreign matter from entering the jar.

14. The lamp-mounting roof fixture of claim 13 further including means latching the mounting plate to the support to hold the mounting plate in its use position, thereby to maintain the sealing engagement of the rim and gasket.

15. The lamp-mounting roof fixture of claim 12 wherein the lamp, the jar, the opening, and the reflector are substantially concentric with one another.

16. In a lamp-mounting elongate roof fixture of the type including an elongate support having a roof-contact portion and an upper portion parallel to and spaced from the roof, a beam over and along the support in position suspended above the roof, and a light source under the beam, the improvement comprising:

an elongate mounting plate having a top and bottom and proximal and distal ends, the mounting plate extending along the support parallel to the upper portion thereof and pivotably attached at its proximal end to the support; and a lamp socket mounted to the bottom of the mounting plate adjacent to the distal end of the mounting plate and supporting a lamp therebelow oriented along an axis substantially perpendicular to the mounting plate;

whereby improved roof illumination is provided by light from below the beam and relamping service is facilitated.

17. The lamp-mounting roof fixture of claim 16 further including a lamp ballast attached to the mounting plate.

18. The lamp-mounting roof fixture of claim 17 wherein the lamp ballast is on the top of the mounting plate.

19. The lamp-mounting roof fixture of claim 18 having a lower end and wherein the proximal end of the mounting plate is spaced from the lower end by a distance approximating the distance from the proximal end to the distal end, thereby to facilitate relamping and ballast service/replacement.

* * * * *